US011162177B2

(12) United States Patent
Nakatsuka et al.

(10) Patent No.: US 11,162,177 B2
(45) Date of Patent: Nov. 2, 2021

(54) PICKLING DEVICE

(71) Applicant: PRIMETALS TECHNOLOGIES JAPAN, LTD., Hiroshima (JP)

(72) Inventors: Ryusuke Nakatsuka, Hiroshima (JP); Kosei Tsuji, Hiroshima (JP); Hideaki Suemori, Hiroshima (JP); Koichi Nakamura, Hiroshima (JP)

(73) Assignee: PRIMETALS TECHNOLOGIES JAPAN, LTD., Hiroshima (JP)

( * ) Notice: Subject to any disclaimer, the term of this patent is extended or adjusted under 35 U.S.C. 154(b) by 917 days.

(21) Appl. No.: 15/756,725

(22) PCT Filed: Feb. 22, 2017

(86) PCT No.: PCT/JP2017/006556
§ 371 (c)(1),
(2) Date: Mar. 1, 2018

(87) PCT Pub. No.: WO2017/187736
PCT Pub. Date: Nov. 2, 2017

(65) Prior Publication Data

US 2018/0258541 A1 Sep. 13, 2018

(30) Foreign Application Priority Data

Apr. 27, 2016 (JP) ..... JP2016-089230

(51) Int. Cl.
*C23G 3/02* (2006.01)
*C23G 1/08* (2006.01)
(Continued)

(52) U.S. Cl.
CPC ..... *C23G 3/021* (2013.01); *B08B 3/041* (2013.01); *B08B 3/08* (2013.01); *B08B 3/10* (2013.01);
(Continued)

(58) Field of Classification Search
None
See application file for complete search history.

(56) References Cited

U.S. PATENT DOCUMENTS

| | | | |
|---|---|---|---|
| 5,248,372 | A | 9/1993 | McNamee |
| 6,340,028 | B1 | 1/2002 | Hirai et al. |
| 2014/0165686 | A1 | 6/2014 | Ukolowicz et al. |

FOREIGN PATENT DOCUMENTS

| | | | |
|---|---|---|---|
| JP | 50-145712 | A | 12/1975 |
| JP | 59-76563 | U | 5/1984 |

(Continued)

OTHER PUBLICATIONS

Office Action dated Feb. 26, 2019 issued in corresponding Japanese Application No. 2016-089230 with English Translation.

(Continued)

*Primary Examiner* — Rita P Adhlakha
(74) *Attorney, Agent, or Firm* — Birch, Stewart, Kolasch & Birch, LLP

(57) ABSTRACT

To prevent over-pickling during pickling pause, shorten the time required to switch between pickling operation and pickling pause, and heat acid solution efficiently, a pickling device includes: a pickling tank for storing acid solution and for pickling a steel strip by allowing the steel strip to travel therethrough while the steel strip is immersed in the acid solution; a heat exchanger for heating the acid solution in the pickling tank; a circulation tank for storing the acid solution, provided separately from the pickling tank; an acid-solution circulation device configured to circulate the acid solution between the pickling tank and the circulation tank; a control device configured to withdraw the steel strip from the acid solution; and a guide plate disposed in the pickling tank and configured to guide the acid solution circulated in the pickling tank by the acid-solution circulation device to the heat exchanger.

10 Claims, 9 Drawing Sheets

(51) Int. Cl.

| | |
|---|---|
| ***B08B 3/04*** | (2006.01) |
| ***B08B 3/08*** | (2006.01) |
| ***B08B 3/10*** | (2006.01) |

(52) U.S. Cl.
CPC ..... *C23G 1/08* (2013.01); *C23G 1/081* (2013.01); *C23G 3/025* (2013.01); *B08B 2203/007* (2013.01)

(56) References Cited

FOREIGN PATENT DOCUMENTS

| | | | |
|---|---|---|---|
| JP | 61-102308 | U | 6/1986 |
| JP | 61-129871 | U | 8/1986 |
| JP | 61-210195 | A | 9/1986 |
| JP | 1-111890 | A | 4/1989 |
| JP | 2-133589 | A | 5/1990 |
| JP | 4-129695 | U | 11/1992 |
| JP | 5-195269 | A | 8/1993 |
| JP | 3160300 | B2 | 2/2001 |
| JP | 2002-53988 | A | 2/2002 |
| JP | 2003-213466 | A | 7/2003 |
| JP | 2006-45612 | A | 2/2006 |
| JP | 2006-307240 | A | 11/2006 |
| JP | 2015-168843 | A | 9/2015 |

OTHER PUBLICATIONS

Extended European Search Report dated Jul. 25, 2018 issued to the corresponding EP Application No. 17789025.8.

Office Action dated Jun. 4, 2019 issued in corresponding Japanese Application No. 2016-089230.

English Translation of the Written Opinion of the ISA dated Apr. 20, 2018 in corresponding International (PCT) Application No. PCT/JP2017/006556.

International Search Report of PCT/JP2017/006556 dated Apr. 4, 2017.

PICKLING DEVICE

TECHNICAL FIELD

The present invention relates to a pickling device.

BACKGROUND ART

A pickling device is a device for cleaning and removing oxidized scales, which are oxidized matter formed on a surface of a steel strip such as a cold-rolled steel plate and a hot-rolled steel plate, by causing the oxidized scales to react with acid solution such as hydrochloric acid and sulfuric acid. In a general pickling device, as a steel strip continuously travels through a pickling tank, the steel strip is immersed in acid solution stored in the pickling tank, and thereby oxidized scales on the surface of the steel strip are removed continuously.

For instance, Patent Document 1 discloses a pickling device including: a pickling tank filled with acid solution; a lid covering an upper part of the pickling tank; an immersion guide roll disposed rotatably on the lower surface of the lid; a support block disposed on the bottom surface of the pickling tank; a bottom plate disposed on an upper part of the support block; and a skid disposed on the upper surface of the bottom plate to face the immersion guide roll, wherein the pickling device performs pickling of a steel strip by causing the steel strip to travel through the acid solution while guiding the steel strip with the immersion guide roll and the skid.

CITATION LIST

Patent Literature

Patent Document 1: JP3160300B

SUMMARY

Problems to be Solved

Meanwhile, in a facility with a pickling device, travel of a steel strip may be stopped temporarily (e.g. from a couple of hours to one day), for maintenance or the like of a device disposed upstream or downstream of the pickling device with respect to the traveling direction of the steel strip. In this case, when travel of the steel strip is stopped while the steel strip is immersed in the acid solution of the pickling tank, pickling of the steel strip advances to cause over-pickling. Thus, in a typical case, the total volume of the acid solution in the pickling tank is transferred to a sub tank provided separately from the pickling tank, or the steel strip is lifted above the acid solution.

One may consider applying the above described lifting device to the pickling device disclosed in Patent Document 1. However, in this case, it is necessary to lift not only the steel strip but also the immersion guide roll, the skid, and the like. Thus, the lifting device needs to be a large device with a high strength, which may increase the apparatus cost. Furthermore, one may also consider applying the above described sub tank to the above described pickling tank. However, a high volume of acid solution needs to be transferred, and the temperature of the acid solution in the sub tank decreases with duration of pickling pause, which may require long time to switch from pickling pause to pickling operation. A heat exchanger may be provided for the sub tank, but the apparatus cost may increase.

Furthermore, during pickling pause, the acid solution inside the pickling tank may be transferred to the sub tank so that the upper limit liquid level of the acid solution in the pickling tank becomes lower than the traveling height of the steel strip. In this case, it is possible to operate the heat exchanger in the pickling tank to heat the acid solution, but the acid solution is not flowing with a traveling steel strip, unlike during pickling, and thus it may be impossible to heat the entire acid solution in the pickling tank efficiently.

In view of the above, the present invention was made to solve the above described problem. An object of the present invention is to provide a pickling device capable of preventing over-pickling of a steel strip during pickling pause and reducing the switching time between pickling operation and pickling pause, as well as efficiently heating the acid solution with a heat exchanger disposed inside the pickling tank, even during pickling pause.

Solution to the Problems

A pickling device according to the present invention for solving the above problem includes: a pickling tank for storing acid solution and for pickling a steel strip by allowing the steel strip to travel therethrough while the steel strip is immersed in the acid solution; a heating unit for heating the acid solution in the pickling tank; an acid-solution storage tank for storing the acid solution, provided separately from the pickling tank; an acid-solution circulation unit configured to circulate the acid solution between the pickling tank and the acid-solution storage tank; a withdrawing unit configured to withdraw the steel strip from the acid solution; and a guide plate disposed in the pickling tank and configured to guide the acid solution circulated in the pickling tank by the acid-solution circulation unit to the heating unit.

Advantageous Effects

According to the present invention, it is possible to prevent over-pickling of a steel strip during pickling pause reliably, reduce the switching time between pickling operation and pickling pause, and heat acid solution efficiently.

DETAILED DESCRIPTION

Hereinafter, embodiments of a pickling device according to the present invention will be described with reference to the drawings. Nevertheless, the present invention should not be limited only to the following embodiments.

First Embodiment

Figure 1A:
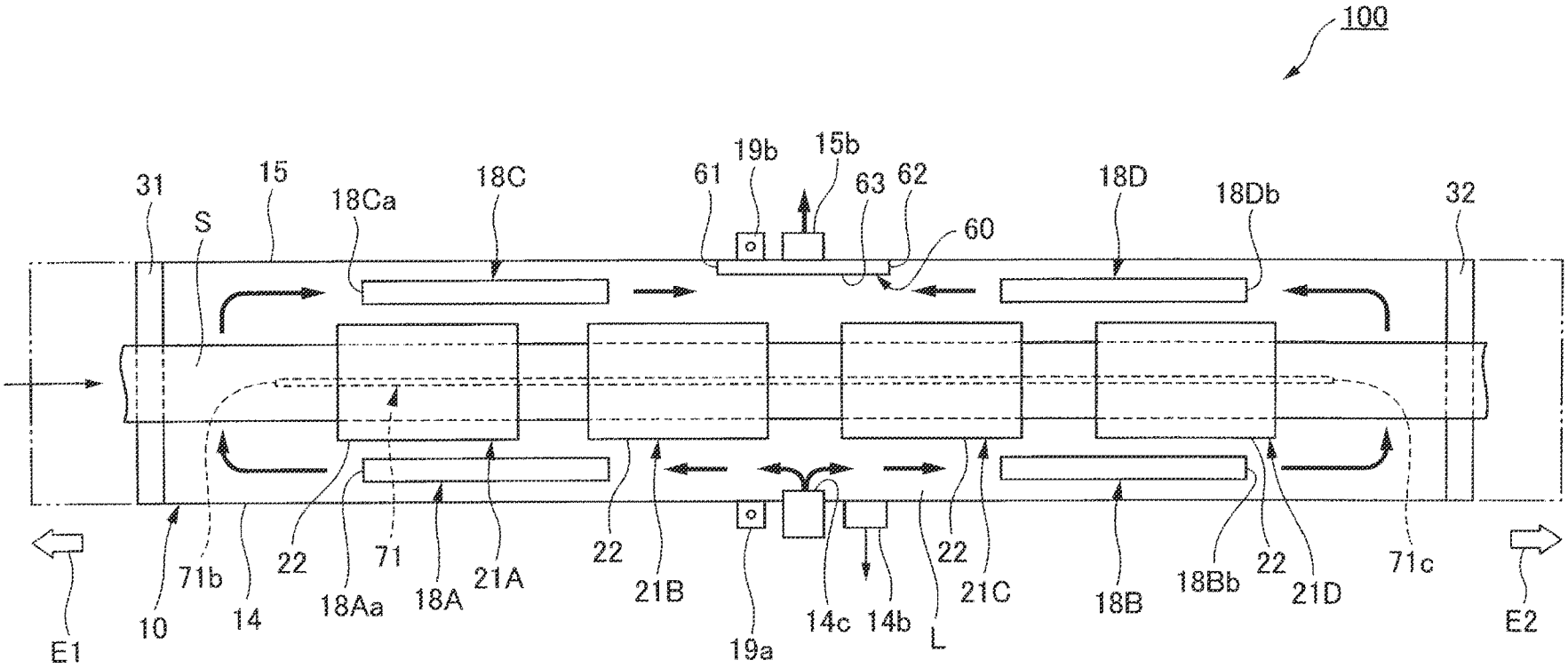
FIG. 1A is a schematic planar view of a pickling device according to the first embodiment of the present invention.
Figure 1B:
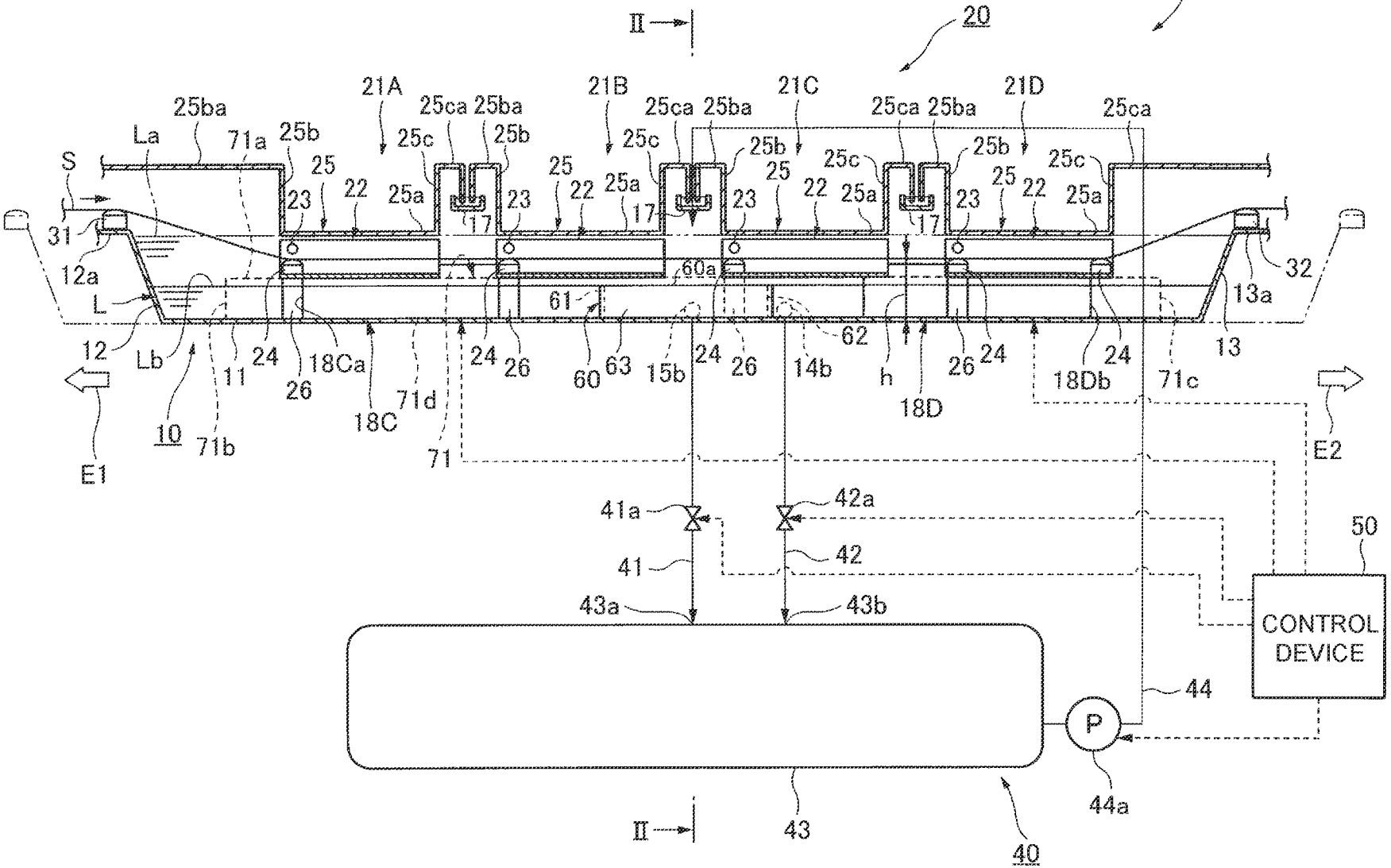
FIG. 1B is a schematic side view of the pickling device.
Figure 2:
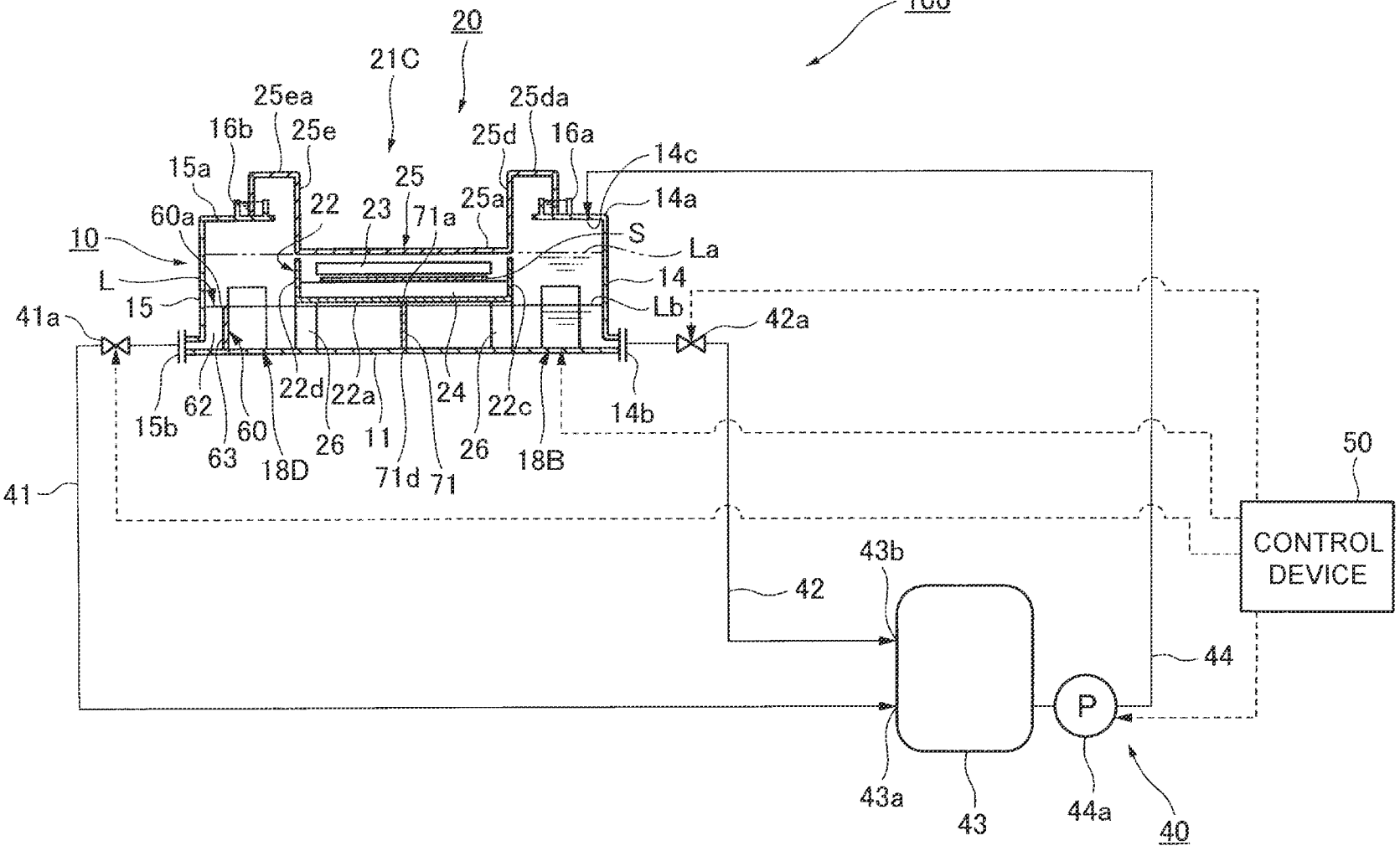
FIG. 2 is a cross-sectional view taken along line II-II in FIG. 1B.

With reference to FIGS. 1A, 1B, and 2, the pickling device according to the first embodiment of the present invention will now be described.

As shown in FIGS. 1A, 1B and 2, a pickling device 100 according to the present embodiment includes a pickling tank 10, a circulation tank (acid-solution storage tank) 43, an acid-solution circulation device (acid-solution circulation unit) 40, and a control device (withdrawing unit) 50.

The pickling tank 10 is a deep tank. The pickling tank 10 includes: a tank body having a bottom plate 11, a front plate 12, a rear plate 13, a right plate 14, and a left plate 15, which is open at the top, and is capable of storing acid solution L; and a plurality of (four in the illustrated example) cover members 25 covering the opening of the tank body. The bottom plate 11 extends in the traveling direction of a steel strip S, and is inclined such that the bottom plate 11 reaches its lowermost point at the first drain port 15*b* (central circulation port) described below in detail. The front plate 12, the rear plate 13, the right plate 14, and the left plate 15 form vertical walls of the pickling tank 10. It is sufficient if the pickling tank 10 is made of an acid-resistant material. The pickling tank 10 may be made of a resin such as polypropylene, or a resin-based composite material.

The front plate 12 is connected to a front end portion of the bottom plate 11, disposed on the upstream side with respect to the traveling direction of the steel strip S. The rear plate 13 is connected to a rear end portion of the bottom plate 11, disposed on the downstream side with respect to the traveling direction of the steel strip S. The right plate 14 is connected to the right end portion of the bottom plate 11 with respect to the width direction, entirely in the traveling direction of the steel strip S. The upstream end portion and the downstream end portion of the right plate 14, with respect to the traveling direction of the steel strip S, are connected to the front plate 12 and the rear plate 13. The left plate 15 is connected to the left end portion of the bottom plate 11 with respect to the width direction, entirely in the traveling direction of the steel strip S. The upstream end portion and the downstream end portion of the left plate 15, with respect to the traveling direction of the steel strip S, are connected to the front plate 12 and the rear plate 13.

The left plate 15 has a first drain port (drain port for the acid solution) 15*b* disposed thereon. The right plate 14 has a second drain port 14*b* and a supply port 14*c* (supply port for the acid solution) disposed thereon. The right plate 14 and the left plate 15 are provided with fixed brackets 19*a*, 19*b*, at the center portion with respect to the traveling direction of the steel strip S. The pickling tank 10 is fixedly positioned on a mount or a base at the fixed brackets 19*a*, 19*b*. Thus, when the pickling tank 10 is affected by heat of the acid solution L, the bottom plate 11 of the pickling tank 10 thermally expands toward each of the upstream side indicated by the arrow E1 and the downstream side indicated by the arrow E2 in FIG. 1A, in the traveling direction of the steel strip S. Especially, the pickling tank 10 has a high thermal expansion coefficient if made of a resin-based material such as polypropylene. Thus, the first drain port (drain port for the acid solution), the second drain port 14*b*, and the supply port 14*c* (supply port for the acid solution) disposed on the center portion at which the pickling tank 10 is fixedly positioned are less affected by thermal expansion, which is preferable.

On the upper end portion side of the front plate 12, a front flange portion 12*a* is formed so as to extend horizontally upstream in the traveling direction of the steel strip S. On the upper end portion side of the rear plate 13, a rear flange portion 13*a* is formed so as to extend horizontally downstream in the traveling direction of the steel strip S. An inlet skid 31 is disposed on the front flange portion 12*a*, and an outlet skid 32 is disposed on the rear flange portion 13*a*.

On the upper end portion side of the right plate 14 and the left plate 15, a right flange portion 14*a* and a left flange portion 15*a* are formed, respectively, so as to extend inward in the width direction of the pickling tank 10. A right receiving portion 16*a* is disposed on the right flange portion 14*a*, and a left receiving portion 16*b* is disposed on the left flange portion 15*a*. The right receiving portion 16*a* and the left receiving portion 16*b* are both filled with seal solution, such that end portions of the right plates 25*d* and the left plates 25*e* of the cover members 25 are immersed in the seal solution. Accordingly, the upper sides of both end portions of the pickling tank 10, with respect to the width direction, are sealed with the cover members 25.

A plurality of (three in the illustrated example) width-directional receiving portions 17 are disposed to connect the right plate 14 and the left plate 15 so as to form a shape that extends in the width direction of the pickling tank 10. The plurality of width-directional receiving portions 17 are arranged next to one another in the traveling direction of the steel strip S.

The plurality of width-directional receiving portions 17 are disposed between guide device bodies (described below) arranged next to one another in the traveling direction of the steel strip S. The width-directional receiving portions 17 are filled with seal solution, such that end portions of the front plates 25*b* and the rear plates 25*c* of the cover members 25 are immersed in the seal solution. Accordingly, the upper sides between the guide device bodies, arranged next to one another with respect to the traveling direction of the steel strip S in the pickling tank 10, are sealed with the cover members 25.

A plurality of (four in the illustrated example) heat exchangers (heating units) 18A to 18D are disposed inside the pickling tank 10. The first and second heat exchangers 18A, 18B are arranged next to one another in the traveling direction of the steel strip S. The third and fourth heat exchangers 18C, 18D are arranged next to one another in the traveling direction of the steel strip S. The first and second heat exchangers 18A, 18B are disposed on the bottom plate 11, under the right flange portion 14*a* and adjacent to the right plate 14 of the pickling tank 10. That is, the first and second heat exchangers 18A, 18B are arranged along the right plate 14 of the pickling tank 10. The third and fourth heat exchangers 18C, 18D are disposed on the bottom plate 11, under the left flange portion 15*a* and adjacent to the left plate 15. That is, the third and fourth heat exchangers 18C, 18D are disposed on the bottom plate 11, along the left plate 15 of the pickling tank 10. The first heat exchanger 18A and the third heat exchanger 18C are disposed plane-symmetrically with respect to the center of the pickling tank 10 with respect to the width direction of the pickling tank 10. The second heat exchanger 18B and the fourth heat exchanger 18D are disposed plane-symmetrically with respect to the center of the pickling tank 10 with respect to width direction of the pickling tank 10. The heat exchangers 18A to 18D are substantially flush with the traveling height h of the steel strip S in the pickling tank 10. Furthermore, the heat exchangers 18A to 18D are each a heat-transfer tube which is arranged to extend in the height direction and the side-plate width direction, and which has a function of indirect heating through supply of a heat medium (e.g. steam) into the tube. Thus, with at least a part of the heat exchangers 18A to 18D being immersed in the acid solution L in the pickling tank 10, it is possible to heat the acid solution L in the pickling tank 10 to a predetermined temperature.

The pickling tank 10 includes a guide device (steel strip guide device) 20 for guiding the steel strip S. The guide device 20 includes a plurality of (four in the illustrated example) guide device bodies 21A to 21D. The plurality of guide device bodies 21A to 21D are arranged next to one another in the traveling direction of the steel strip S. The guide device bodies 21A to 21D each includes a gutter-shaped member (immersion box) 22 having a U-shaped lateral cross section, an immersion guide roll 23, a skid 24, and a support block 26.

The gutter-shaped member 22 has a shape that extends in the traveling direction of the steel strip S and has openings on the upstream side and the downstream side with respect to the traveling direction of the steel strip S. The gutter-shaped member 22 has a bottom plate portion 22*a*, a right plate portion 22*c*, and a left plate portion 22*d*. The right plate portion 22*c* and the left plate portion 22*d* are disposed so as to face each other. An end portion of the bottom plate portion 22*a* (an end portion with respect to the width direction of the steel strip S) and the other end portion of the bottom plate portion 22*a* (the other end portion with respect to the width direction of the steel strip S) are connected to the right plate portion 22*c* and the left plate portion 22*d* entirely in the traveling direction of the steel strip S. The gutter-shaped member 22 is supported by the support block 26.

The skid 24 is disposed on the front end portion side of the bottom plate portion 22*a*, which forms an upstream end portion with respect to the traveling direction of the steel strip S. In the fourth guide device body 21D disposed downstream with respect to the traveling direction of the steel strip S, the skid 24 is also disposed on the rear end portion side of the bottom plate portion 22*a*, which forms a downstream end portion with respect to the traveling direction of the steel strip S. An immersion guide roll 23 is disposed on the front end portion side of a cover member body 25*a* described below in detail, which forms an upstream end portion with respect to the traveling direction of the steel strip S.

The support block 26 is disposed below the skid 24, on the front end portion side of the bottom plate portion 22*a*, which forms an upstream end portion with respect to the traveling direction of the steel strip S. The support block 26 is disposed on each of both end portions with respect to the width direction of the steel strip S. Accordingly, the guide device bodies 21A to 21D are arranged at a predetermined height inside the pickling tank 10. Thus, during pickling operation for the steel strip S, the pickling tank 10 is filled with acid solution L to the substantially same height as the guide device bodies 21A to 21D, and the steel strip S is guided while being immersed in the acid solution L (at a predetermined traveling height h).

The cover member 25 includes a cover member body 25*a*, a front plate 25*b*, a rear plate 25*c*, a right plate 25*d*, and a left plate 25*e*. The cover member body 25*a* has a plate shape. The cover member body 25*a* is disposed above the gutter-shaped member 22.

The front plate 25*b* has a shape that connects to the front end portion of the cover member body 25*a*, and extends upward. On the upper end portion side of the front plate 25*b*, a front flange portion 25*ba* is formed so as to extend upstream in the traveling direction of the steel strip S. With regard to the cover member 25 arranged corresponding to each of the second to fourth guide device bodies 21B to 21D, a tip end portion of the front flange portion 25*ba* of the front plate 25*b* is bended downward and immersed in seal solution stored in the width-directional receiving portion 17.

The rear plate 25*c* has a shape that connects to the rear end portion of the cover member body 25*a*, and extends upward. On the upper end portion of the rear plate 25*c*, a rear flange portion 25*ca* is formed so as to extend downstream in the traveling direction of the steel strip S. With regard to the cover member 25 arranged corresponding to each of the first to third guide device bodies 21A to 21C, a tip end portion of the rear flange portion 25*ca* of the rear plate 25*c* is bended downward and immersed in the seal solution stored in the width-directional receiving portion 17.

The right plate 25*d* has a shape that connects to the right end portion of the cover member body 25*a*, and extends upward. On the upper end portion side of the right plate 25*d*, a right flange portion 25*da* is formed so as to extend outward in the width direction of the steel strip S. A tip end portion of the right flange portion 25*da* is bended downward and immersed in the seal solution stored in the right receiving portion 16*a*.

The left plate 25*e* has a shape that connects to the left end portion of the cover member body 25*a*, and extends upward. On the upper end portion of the left plate 25*e*, a left flange portion 25*ea* is formed so as to extend outward in the width direction of the steel strip S. A tip end portion of the left flange portion 25*ea* is bended downward and immersed in the seal solution stored in the left receiving portion 16*b*.

Accordingly, the cover members 25 provided corresponding to the first to fourth guide device bodies 21A to 21D cover the pickling tank 10 from above.

The acid-solution circulation device 40 includes a first drain pipe 41, a second drain pipe 42, and a supply pipe (return pipe) 44. The first drain pipe 41 has a root end side (an end portion side) connected to the first drain port 15*b* of the pickling tank 10, and a distal end side (the other portion side) connected to the circulation tank 43. An opening-and-closing valve 41*a* is disposed in the first drain pipe 41. The second drain pipe 42 has a root end side connected to the second drain port 14*b* of the pickling tank 10, and a distal end side (the other end portion side) connected to the circulation tank 43. An opening-and-closing valve 42*a* is disposed in the second drain pipe 42. The supply pipe 44 has a root end side (an end portion side) connected to the circulation tank 43, and a distal end side (the other end portion side) connected to the supply port 14*c* of the pickling tank 10. A circulation pump 44*a* is disposed in the supply pipe 44. Preferably, the first supply port 43*a* of the circulation tank 43 connected to the distal end side of the first drain pipe 41 is positioned below the upper end portion 60*a* of a dam 60 disposed inside the pickling tank 10. In this way, it is possible to discharge the acid solution L above the dam 60 from the pickling tank 10 efficiently. Furthermore, preferably, the second supply port 43*b* of the circulation tank 43 connected to the distal end side of the second drain pipe 42 is positioned below the bottom plate 11 of the pickling tank 10. In this way, it is possible to discharge the total volume of the acid solution L in the pickling tank 10 from the pickling tank 10 efficiently.

The pickling device 100 further includes a dam 60 disposed inside the pickling tank 10. The dam 60 has a shape that surrounds the first drain port 15*b*, and includes a front plate portion 61, a rear plate portion 62, and a side plate portion 63. The front plate portion 61 of the dam 60 has a shape that connects to the left plate 15 and the bottom plate 11 and extends in the width direction of the pickling tank 10. The rear plate portion 62 of the dam 60 is connected to the left plate 15 and the bottom plate 11. The rear plate portion 62 of the dam 60 is disposed at a distance from the front plate portion 61, and has a shape that extends parallel to the front plate portion 61. The side plate portion 63 of the dam 60 has a shape that connects to an end portion of the front plate portion 61, an end portion of the rear plate portion 62, and the bottom plate 11, and extends in the traveling direction of the steel strip S. The upper end portion (inlet) 60*a* of the dam 60 is preferably disposed in a range below the traveling height h of the steel strip S inside the pickling tank 10, and above the ⅓ height of the liquid level La of the acid solution L during pickling operation. More preferably, the upper end portion 60*a* of the dam 60 is disposed in a range below the bottom plate portion 22*a* of the gutter-shaped member 22 and above the ½ height of the liquid level La of the acid solution L during pickling operation. In this way, during pickling pause, it is possible to heat the acid solution L with the heat exchangers 18A to 18D efficiently, while suppressing a discharge amount of the acid solution L from the pickling tank 10. Furthermore, it is possible to switch between pickling operation and pickling pause in a small amount of time. In other words, the dam 60 forms an inflow passage connecting to the first drain port 15*b*, and forms a part of a withdrawing unit configured to withdraw the steel strip S from the acid solution L by allowing the acid solution L to flow over the upper end portion 60*a* to adjust the liquid level Lb of the acid solution L to be below the traveling height h of the steel strip S. It should be noted that the inflow passage may be disposed outside the pickling tank 10, with the inlet connected to the left plate 15 of the pickling tank 10.

Preferably, the dam 60 and the pickling tank 10 are made of the same material. If the pickling tank 10 is made of a resin, the dam 60 may be preferably made of the same resin as the pickling tank 10. In this way, the dam 60 can expand thermally along with the pickling tank 10, which holds the acid solution L having a high temperature (e.g. 85 to 90° C.) during pickling operation and pickling pause. If the pickling tank 10 and the dam 60 are made of different materials, there is an increased risk of breakage occurring due to difference in the thermal expansion at joints between the pickling tank 10 and the dam 60.

The above described pickling device 100 further includes a guide plate (acid-solution guide plate) 71 disposed inside the pickling tank 10. The guide plate 71 has a shape which extends along the traveling direction of the steel strip S. The guide plate 71 has the substantially same height as the bottom plate portion 22*a* of the gutter-shaped member 22 of the guide device 20 disposed in the pickling tank 10. The upper end portion 71*a* of the guide plate 71 is positioned directly below the bottom plate portion 22*a* of the gutter-shaped member 22 of the guide device 20. The lower end portion 71*d* of the guide plate 71 is fixed to the bottom plate 11 of the pickling tank 10.

Preferably, the guide plate 71 is disposed between the first drain port 15*b* and the supply port 14*c* in the pickling tank 10. In this way, it is possible to guide the acid solution L to the heat exchangers 18A to 18D and heat the entire acid solution L efficiently, as compared to a case in which the acid solution L flows linearly from the supply port 14*c* to the first drain port 15*b*. Furthermore, preferably, the guide plate 71 is disposed between the first and second heat exchangers 18A, 18B arranged along the right plate (a side plate) 14, and between the third and fourth heat exchangers 18C, 18D arranged along the left plate (the other side plate) 15. In this way, it is possible to guide the acid solution L to the heat exchangers 18A to 18D and heat the entire acid solution L efficiently. Preferably, the guide plate 71 is disposed in the center of the pickling tank 10 with respect to the width direction. In this way, it is possible to beat the acid solution with a good balance between the first and second heat exchangers 18A, 18B arranged along the right plate 14, and the third and fourth heat exchangers 18C, 18D arranged along the left plate 15.

Preferably, the guide plate 71 has a shape which extends upstream, with respect to the traveling direction of the steel strip S, from the front end portions 18Aa, 18Ca of the first and third heat exchangers 18A, 18C disposed most upstream with respect to the traveling direction of the steel strip S, and which extends downstream, with respect to the traveling direction of the steel strip S, from the rear end portions 18Bb, 18Db of the second and fourth heat exchangers 18B, 18D disposed most downstream with respect to the traveling direction of the steel strip S. Accordingly, the front end portion 71*b* of the guide plate 71 is positioned on the upstream side of the first and third heat exchangers 18A, 18C, with respect to the traveling direction of the steel strip S. Furthermore, the rear end portion 71*c* of the guide plate 71 is positioned on the downstream side of the second and fourth heat exchangers 18B, 18D, with respect to the traveling direction of the steel strip S. Accordingly, in a range where the first to fourth heat exchangers 18A to 18D are arranged in the traveling direction of the steel strip S, the region on the side of the right plate 14 of the pickling tank 10 and the region on the side of the left plate 15 of the pickling tank 10 are divided in the width direction of the steel strip S. Furthermore, in the region upstream of the first and third heat exchangers 18A, 18C with respect to the traveling direction of the steel strip S and in the region downstream of the second and fourth heat exchangers 18B, 18D with respect to the traveling direction of the steel strip S, the acid solution L can flow between the regions on the side of the right plate 14 and the side of the left plate 15 of the pickling tank 10. Similarly to the pickling tank 10, it is sufficient if the guide plate 71 is made of an acid-resistant material. The pickling tank 10 may be made of a resin such as polypropylene, or a resin-based composite material.

Accordingly, the region is divided into the side of the heat exchangers 18A, 18C disposed adjacent to the right plate 14 of the pickling tank 10, and the side of the heat exchangers 18B, 18D disposed adjacent to the left plate 15 of the pickling tank 10. Thus, it is possible to make efficient use of all of the heat exchangers 18A to 18D in heating of the acid solution L from when the acid solution L is supplied to the pickling tank 10 and to when the acid solution L is discharged from the pickling tank 10.

The control device 50 is a device for controlling each component of the pickling device 100. The output side of the control device 50 is connected to the heat exchangers 18A to 18D, the opening-and-closing valves 41*a*, 42*a*, and the circulation pump 44*a*, and is configured to be capable of controlling these components.

The main operation of the above described pickling device 100 will be described below.

During pickling operation, the control device 50 controls the heat exchangers 18A to 18D so as to heat the acid solution L to a predetermined temperature (e.g. 85 to 90° C.), and controls the acid-solution circulation device 40 such that the acid solution L does not circulate. In other words, the control device 50 controls the opening-and-closing valves 41*a*, 42*a* disposed in the first and second drain pipes 41, 42 to be fully closed, and controls the circulation pump 44*a* to stop. Accordingly, inside the pickling tank 10, the acid solution L is heated to the predetermined temperature, and the liquid level La of the acid solution L is maintained at the substantially same level as the cover member bodies 25*a* of the cover members 25. Thus, the steel strip S undergoes the pickling process, by traveling through the acid solution L while being immersed in the acid solution L, guided by the immersion guide rolls 23 and the skids 24.

During pickling pause, in which pickling operation is stopped temporarily (e.g. from a couple of hours to one day), the control device 50 controls the heat exchangers 18A to 18D so as to heat the acid solution L to a predetermined temperature (e.g. 85 to 90° C.), and controls the acid-solution circulation device 40 so as to circulate the acid solution L. In other words, the control device 50 controls the opening-and-closing valve 42*a* disposed in the second drain pipe 42 to be fully closed, and controls the opening-and-closing valve 41*a* disposed in the first drain pipe 41 to be fully open. Accordingly, the acid solution L inside the pickling tank 10 flows over the upper end portion 60*a* of the dam 60 toward the vicinity of the first drain port 15*b*, and then flows from the first drain port 15*b* through the first drain pipe 41 into the circulation tank 43, where the acid solution L is temporarily stored. Furthermore, the acid solution L inside the pickling tank 10 is discharged into the circulation tank 43 via the first drain pipe 41, such that the liquid level Lb of the acid solution L inside the pickling tank 10 becomes substantially flush with the upper end portion 60*a* of the dam 60. Then, the control device 50 controls the opening degree of the opening-and-closing valve 41*a*, and controls the circulation pump 44*a* to operate. Accordingly, the acid solution L stored temporarily inside the circulation tank 43 flows into the pickling tank 10 via the supply pipe 44 in response to operation of the circulation pump 44*a*. That is, the first drain pipe 41 and the supply pipe 44 form two flow passages through which the acid solution L flows between the pickling tank 10 and the circulation tank 43. Whether the acid solution L is substantially flush with the upper end portion 60*a* of the dam 60 may be determined on the basis of a signal from a liquid level sensor provided in advance, or on the basis of elapse of time that the acid solution L takes to reach the upper end portion 60*a* of the dam 60, the time being obtained in advance. Through design or adjustment to keep the flow volume (supply amount) of acid solution supplied to the pickling tank 10 with the circulation pump 44*a* below a flow volume (discharge amount) at which acid solution can flow out the pickling tank 10 over the dam 60, the liquid level Lb of the acid solution L can be maintained at the same level as the upper end portion 60*a* of the dam 60. Furthermore, the position below the upper end portion 60*a* of the dam 60 may be used as a criteria for determining whether to supply the acid solution L from the circulation tank 43 to the pickling tank 10.

Furthermore, inside the pickling tank 10, as indicated by the arrow in FIG. 1A, once the acid solution L is fed into the pickling tank 10 from the supply port 14*c*, the acid solution L flows along the right plate 14 (a side wall) of the pickling tank 10 toward each of the upstream side and the downstream side with respect to the traveling direction of the steel strip S. As the acid solution L reaches the most upstream side and the most downstream side, the acid solution L flows between the front end portion 71*b* of the guide plate 71 and the front plate 12 of the pickling tank 10, and between the rear end portion 71*c* of the guide plate 71 and the rear plate 13 of the pickling tank 10, respectively, toward the left plate (the other side wall) 15 of the pickling tank 10. Furthermore, the acid solution L flows along the left plate 15 toward the first drain port 15*b* via the dam 60 in the center with respect to the traveling direction of the steel strip S.

Thus, during pickling pause, the liquid level Lb of the acid solution L inside the pickling tank 10 is lowered to the substantially same level as the upper end portion 60*a* of the dam 60, which is below the traveling height h of the steel strip S inside the pickling tank 10. In this state, the acid solution L is circulated by the acid-solution circulation device 40 between the pickling tank 10 and the circulation tank 43, and the circulating acid solution L is guided by the guide plate 71 to the heat exchangers 18A to 18D through a predetermined flow path. Accordingly, the acid solution L is heated to the predetermined temperature by the heat exchangers 18A to 18D inside the pickling tank 10.

Thus, according to the present embodiment, during pickling pause, in which pickling of the steel strip S is temporarily stopped, the acid solution L circulates between the pickling tank 10 and the circulation tank 43 while the liquid level of the acid solution L inside the pickling tank 10 is adjusted to be below the traveling height h of the steel strip S so that the steel strip S is withdrawn from the acid solution L, and thereby it is possible to prevent over-pickling of the steel strip S. Furthermore, the acid solution L is circulated between the pickling tank 10 and the circulation tank 43 by the acid-solution circulation device, the guide plate 71 guides the acid solution L to the heat exchangers 18A to 18D, and the heat exchangers 18A to 18D heat the acid solution L to a predetermined temperature. Thus, as compared to a case in which the total volume of acid solution is discharged from the pickling tank and stored in a tank separate from the pickling tank, a smaller volume of the acid solution is returned to the pickling tank, which makes it possible to prevent a temperature decrease of the acid solution due to storage of the acid solution in a separate tank, and to shorten the time required to switch between pickling operation and pickling pause.

The control device 50 is configured to control opening and closing of the opening-and-closing valve 41*a* and operation of the circulation pump 44*a* to adjust the liquid level Lb of the acid solution L in the pickling tank 10 to be below the traveling height h of the steel strip S, so as to withdraw the steel strip S from the acid solution L. Therefore, even though the configuration is simple, the control device 50 can prevent over-pickling of the steel strip S during pickling pause reliably, and to shorten the time required to switch between pickling operation and pickling pause, heating the acid solution L efficiently.

The pickling tank 10 has a depth such that the upper edge of each heat exchanger 18A to 18D is arranged in the acid solution L at the substantially same level as the traveling height h of the steel strip S, and the pickling tank 10 is provided with the guide device 20 for guiding the steel strip S to travel at a predetermined height in the acid solution L when the steel strip S is pickled with the acid solution L in the pickling tank 10. Accordingly, it is possible to prevent over-pickling of the steel strip during pickling pause reliably and shorten the time required to switch between pickling operation and pickling pause, even though the configuration is simple, as compared to a case in which the guide device and the steel strip S are lifted above the liquid level of the acid solution with a lifting device or the total volume of the acid solution in the pickling tank is transported to a separate tank during pickling pause.

Second Embodiment

Figure 3A:
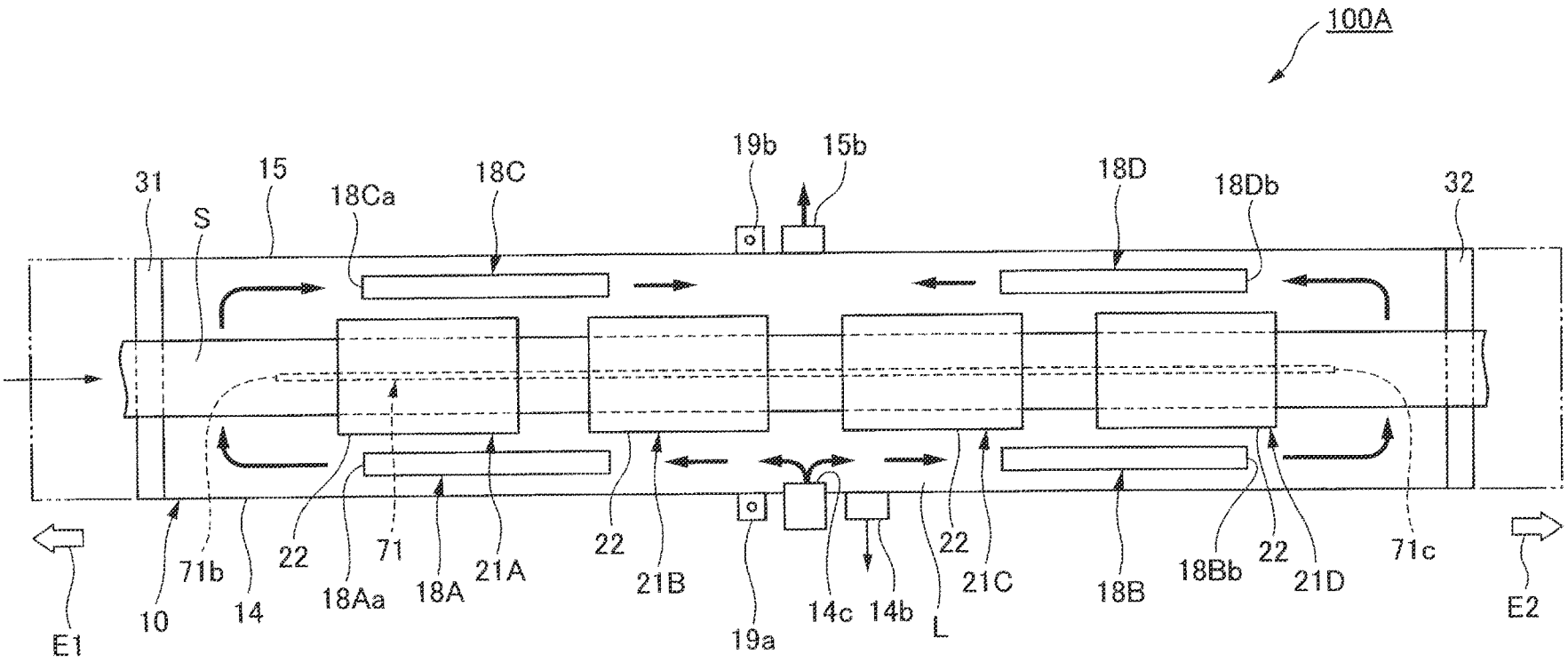
FIG. 3A is a schematic planar view of a pickling device according to the second embodiment of the present invention.
Figure 3B:
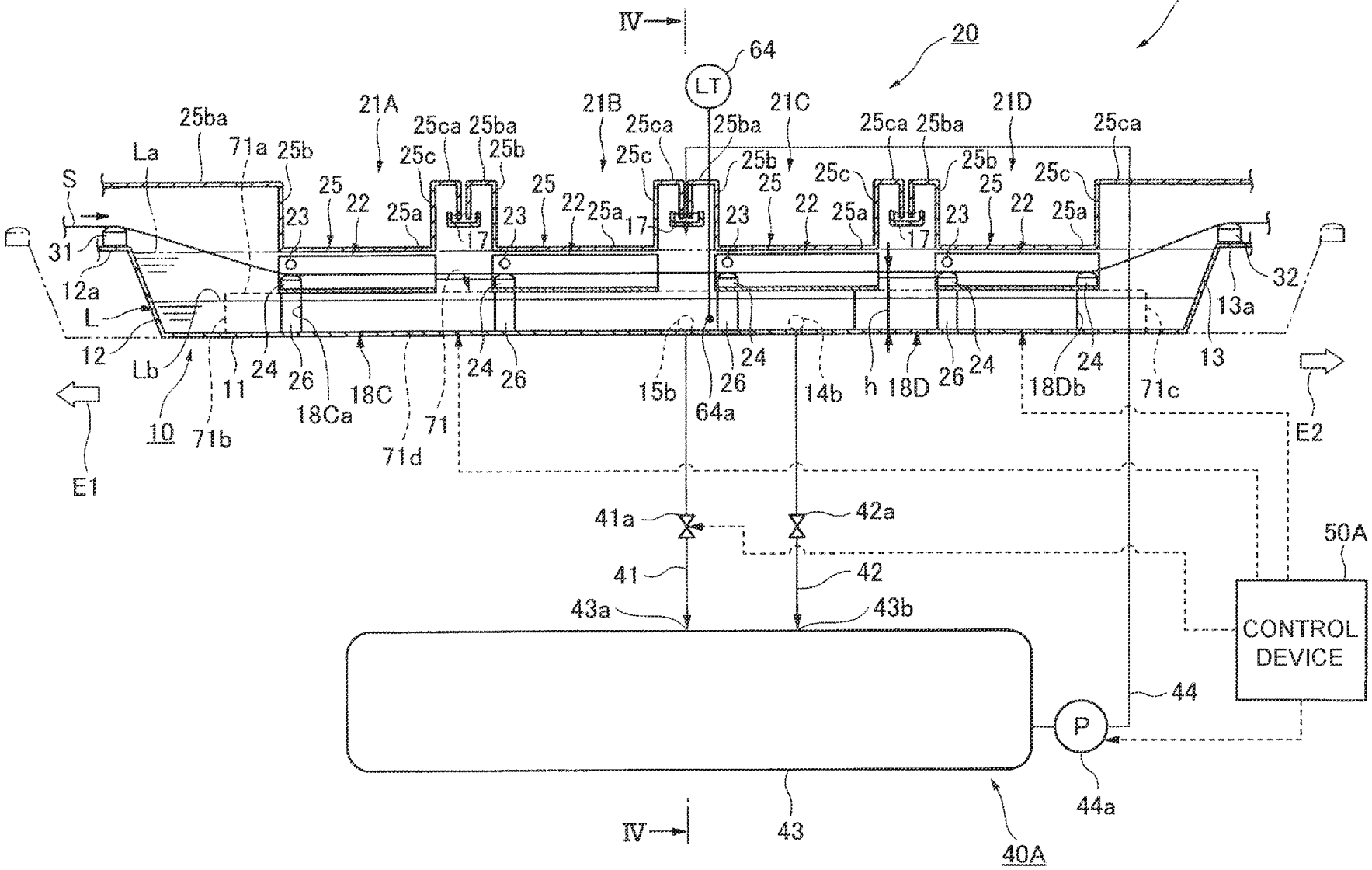
FIG. 3B is a schematic side view of the pickling device.
Figure 4:
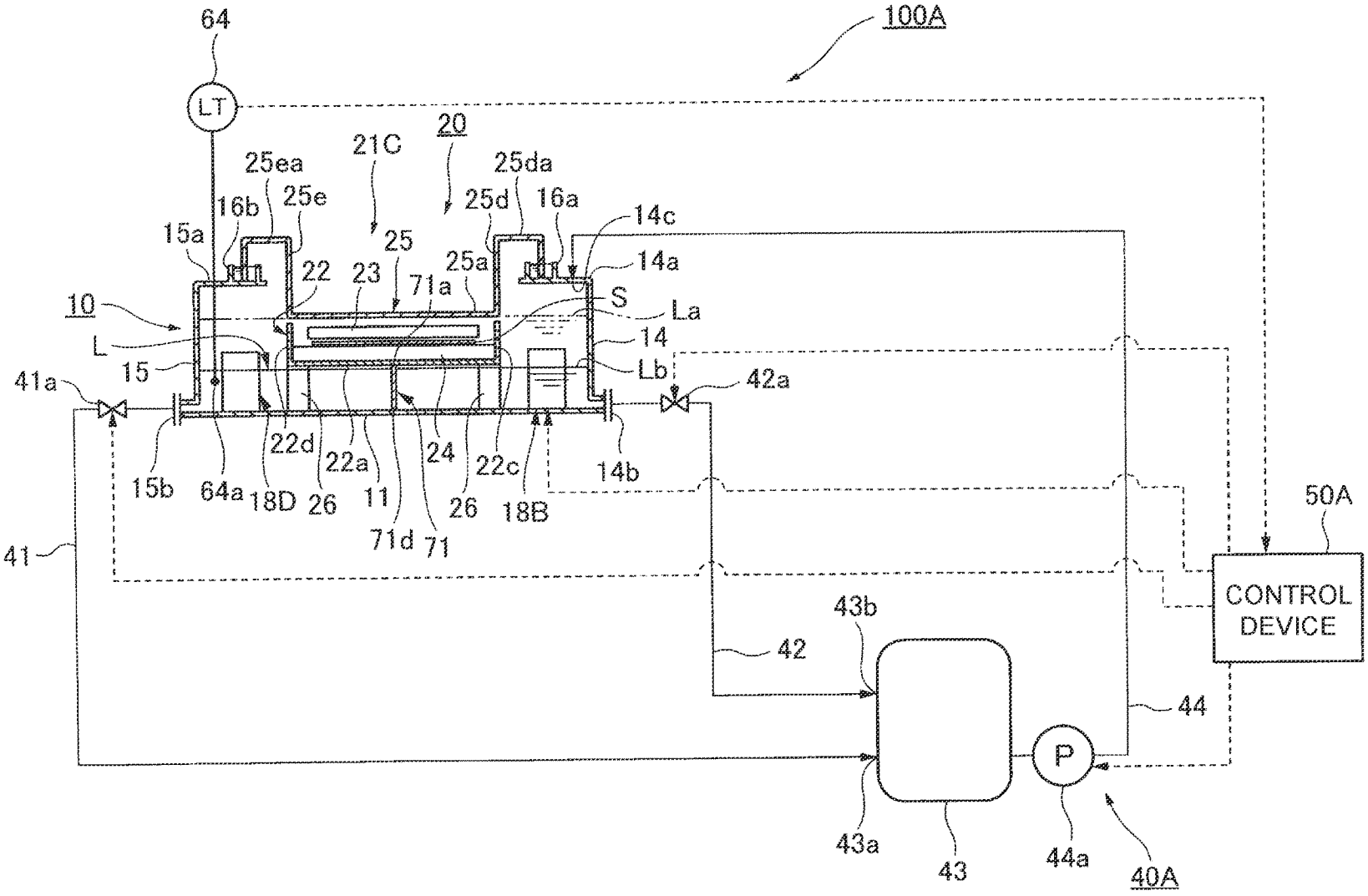
FIG. 4 is a cross-sectional view taken along line IV-IV in FIG. 3B.

With reference to FIGS. 3A, 3B, and 4, the pickling device according to the second embodiment of the present invention will now be described.

The present embodiment has a configuration in which the acid-solution circulation device and the control device provided for the above described first embodiment shown in FIGS. 1A, 1B, and 2 are modified. The other configuration is similar to that of the above described device shown in FIGS. 1A, 1B, and 2, and the same feature is indicated by the same reference numeral and not described again in detail.

As shown in FIGS. 3A, 3B, and 4, a pickling device 100A according to the present embodiment includes the same devices as the pickling device 100 according to the above described first embodiment, as well as an acid-solution circulation device (acid-solution circulation unit) 40A, a liquid level sensor (liquid level measurement unit) 64, and a control device (withdrawing unit) 50A.

The acid-solution circulation device 40A includes a first drain pipe 41, an opening-and-closing valve 41*a*, a supply pipe 44, and a circulation pump 44*a*. In the present embodiment, the opening degree of the opening-and-closing valve 41*a* is controlled, and the timing for driving the circulation pump 44*a* is also controlled. Accordingly, the acid solution L inside the pickling tank 10 is fed into the pickling tank 10 via the first drain pipe 41, the circulation tank 43, and the supply pipe 44, and inside the pickling tank 10, the liquid level Lb of the acid solution L is maintained at a predetermined level, below the traveling height h of the steel strip S.

The liquid level sensor 64 is a device for detecting the liquid level of the acid solution L inside the pickling tank 10. The tip end portion 64*a* of the liquid level sensor 64 is positioned below the gutter-shaped member 22 of the guide device 20. The output side of the liquid level sensor 64 is connected to the control device 50A, and the liquid level sensor 64 detects the liquid level of the acid solution L inside the pickling tank 10 and sends information related to the liquid level of the acid solution L to the control device 50A.

The input side of the control device 50A is connected to the liquid level sensor 64. The output side of the control device 50A is connected to the heat exchangers 18A to 18D, the opening-and-closing valve 41*a*, and the circulation pump 44*a*.

The main operation of the above described pickling device 100A will be described below.

During pickling operation, similarly to the control device 50 of the above described pickling device 100, the control device 50A controls the heat exchangers 18A to 18D so as to heat the acid solution L to a predetermined temperature (e.g. 85 to 90° C.), and controls the acid-solution circulation device 40A so as not to circulate the acid solution L. In other words, the control device 50A controls the opening-and-closing valves 41*a*, 42*a* disposed in the first and second drain pipes 41, 42 to be fully closed, and controls the circulation pump 44*a* to stop. Accordingly, inside the pickling tank 10, the acid solution L is heated to the predetermined temperature, and the liquid level La of the acid solution L is maintained at the substantially same level as the cover member bodies 25*a* of the cover members 25. Thus, the steel strip S undergoes the pickling process, by traveling through the acid solution L while being immersed in the acid solution L, guided by the immersion guide rolls 23 and the skids 24.

During pickling pause, in which pickling operation is stopped temporarily (e.g. from a couple of hours to one day), the control device 50A controls the heat exchangers 18A to 18D so as to heat the acid solution L to a predetermined temperature (e.g. 85 to 90° C.), and controls the acid-solution circulation device 40A so as to circulate the acid solution L. In other words, the control device 50A controls the opening-and-closing valve 42*a* disposed in the second drain pipe 42 to be fully closed, and controls the opening-and-closing valve 41*a* disposed in the first drain pipe 41 to be fully open. Accordingly, the acid solution L inside the pickling tank 10 flows from the first drain port 15*b* through the first drain pipe 41 into the circulation tank 43, in which the acid solution L is temporarily stored. Then, when the height of the liquid level Lb of the acid solution L inside the pickling tank 10 detected by the liquid level sensor 64 is below the guide device bodies 21A to 21D, the control device 50A controls the opening degree of the opening-and-closing valve 41*a*, and controls the circulation pump 44*a* to operate. Accordingly, the acid solution L stored temporarily inside the circulation tank 43 flows into the pickling tank 10 via the supply pipe 44 in response to operation of the circulation pump 44*a*.

Furthermore, inside the pickling tank 10, as indicated by the arrow in FIG. 3A, once the acid solution L is supplied into the pickling tank 10 from the supply port 14*c*, the acid solution L flows along the right plate 14 (a side wall) of the pickling tank 10 toward each of the upstream side and the downstream side with respect to the traveling direction of the steel strip S. As the acid solution L reaches the most upstream side and the most downstream side, the acid solution L flows between the front end portion 71*b* of the guide plate 71 and the front plate 12 of the pickling tank 10, and between the rear end portion 71*c* of the guide plate 71 and the rear plate 13 of the pickling tank 10, respectively, toward the left plate (the other side wall) 15 of the pickling tank 10. Furthermore, the acid solution flows along the left plate 15 toward the first drain port 15*b* in the center with respect to the traveling direction of the steel strip S.

Accordingly, during pickling pause, the liquid level Lb of the acid solution L inside the pickling tank 10 is lowered to a level below the traveling height h of the steel strip S inside the pickling tank 10, and in this state, the acid solution L is circulated by the acid-solution circulation device 40A between the pickling tank 10 and the circulation tank 43, and the circulating acid solution L is guided by the guide plate 71 to the heat exchangers 18A to 18D through a predetermined flow path. Accordingly, the acid solution L is heated to the predetermined temperature by the heat exchangers 18A to 18D inside the pickling tank 10.

Thus, according to the present embodiment, similarly to the above described first embodiment, during pickling pause, in which pickling of the steel strip S is temporarily stopped, the acid solution L circulates between the pickling tank 10 and the circulation tank 43 while the liquid level of the acid solution L inside the pickling tank 10 is adjusted to be below the traveling height h of the steel strip S so that the steel strip S is withdrawn from the acid solution L, and thereby it is possible to prevent over-pickling of the steel strip S. Furthermore, the acid solution L is circulated between the pickling tank 10 and the circulation tank 43 by the acid-solution circulation device 40A, and the guide plate 71 guides the acid solution L to the heat exchangers 18A to 18D, so that the heat exchangers 18A to 18D heat the acid solution L to a predetermined temperature. Thus, as compared to a case in which the total volume of acid solution is discharged from the pickling tank and stored in a tank separate from the pickling tank, a smaller volume of the acid solution L is returned to the pickling tank 10, which makes it possible to prevent a temperature decrease of the acid solution due to storage of the acid solution in a separate tank, and to shorten the time required to switch between pickling operation and pickling pause.

The control device 50A is configured to control opening and closing of the opening-and-closing valve 41*a* and operation of the circulation pump 44*a* to adjust the liquid level Lb of the acid solution L in the pickling tank 10 to be below the traveling height h of the steel strip S, so as to withdraw the steel strip S from the acid solution L. Therefore, even though the configuration is simple, the control device 50 can prevent over-pickling of the steel strip S during pickling pause reliably, and to shorten the time required to switch between pickling operation and pickling pause.

The control device 50A is configured to control opening and closing of the opening-and-closing valve 41*a* and operation of the circulation pump 44*a* on the basis of the liquid level of the acid solution L measured by the liquid level sensor 64. The liquid level Lb of the acid solution L in the pickling tank 10 is adjusted to be below the traveling height h of the steel strip S, so as to withdraw the steel strip S from the acid solution L. Therefore, even though the configuration is simple, the control device 50 can prevent over-pickling of the steel strip S during pickling pause even more reliably, shorten the time required to switch between pickling operation and pickling pause, and heat the acid solution efficiently.

Third Embodiment

Figure 5A:
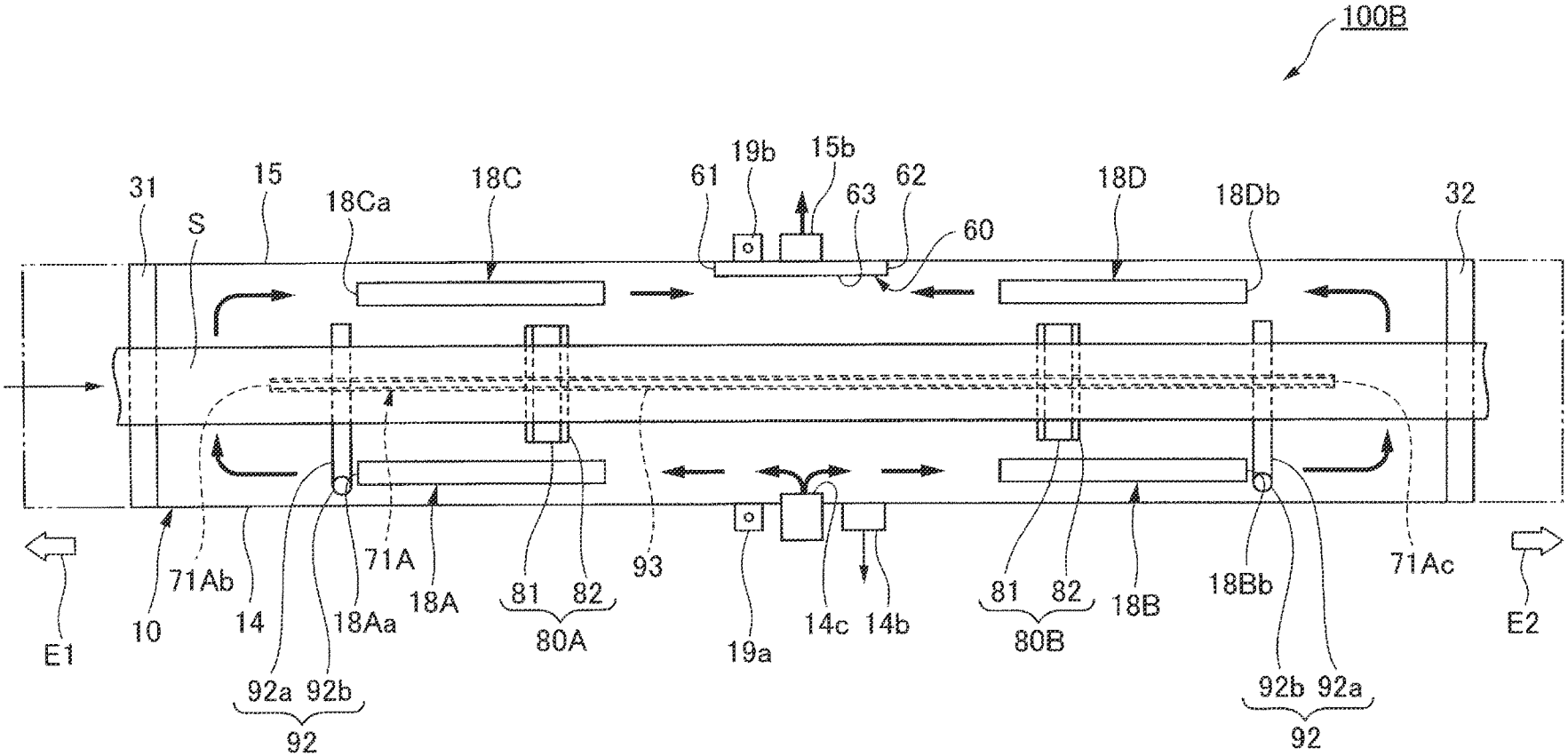
FIG. 5A is a schematic planar view of a pickling device according to the third embodiment of the present invention.
Figure 5B:
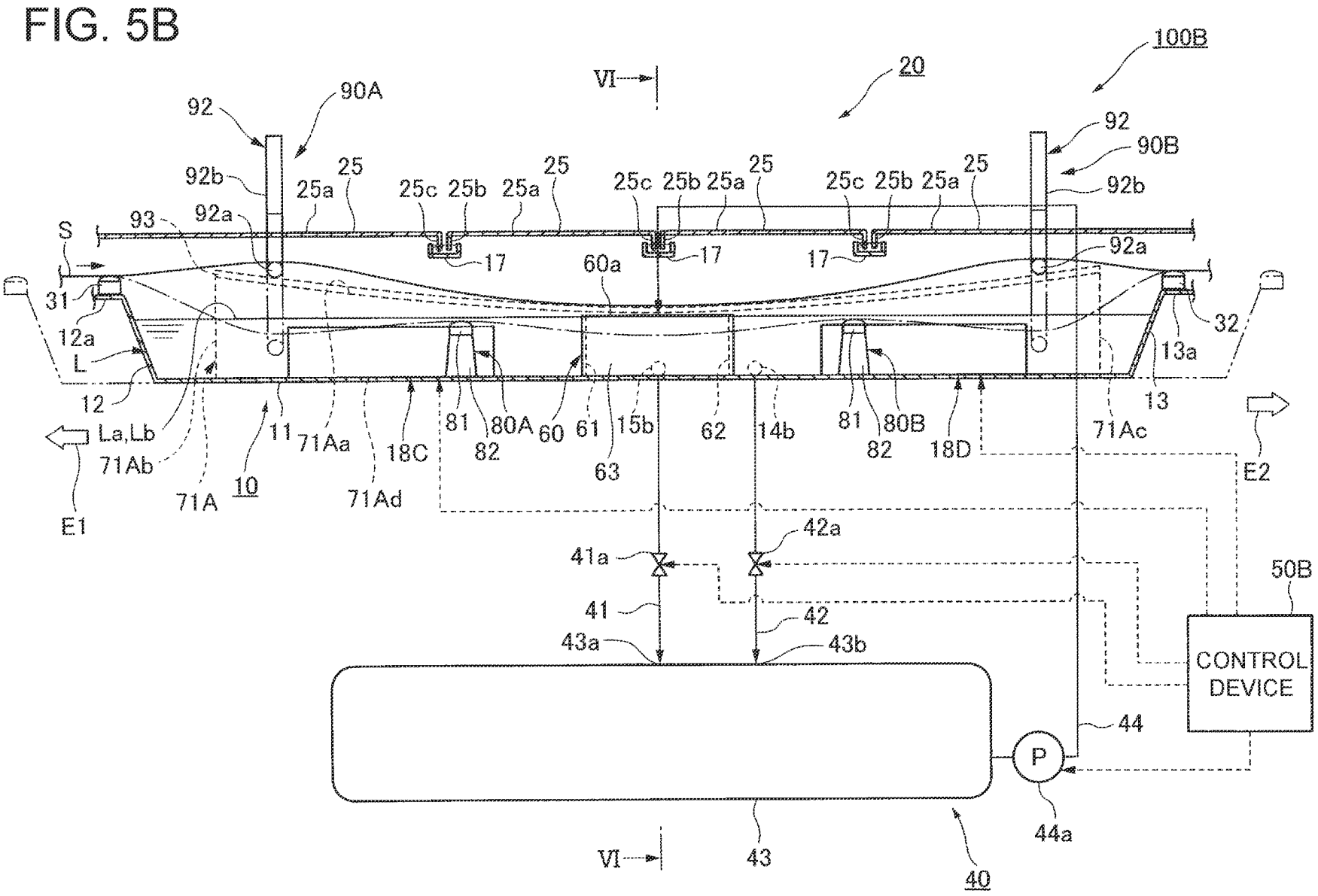
FIG. 5B is a schematic side view of the pickling device.
Figure 6:
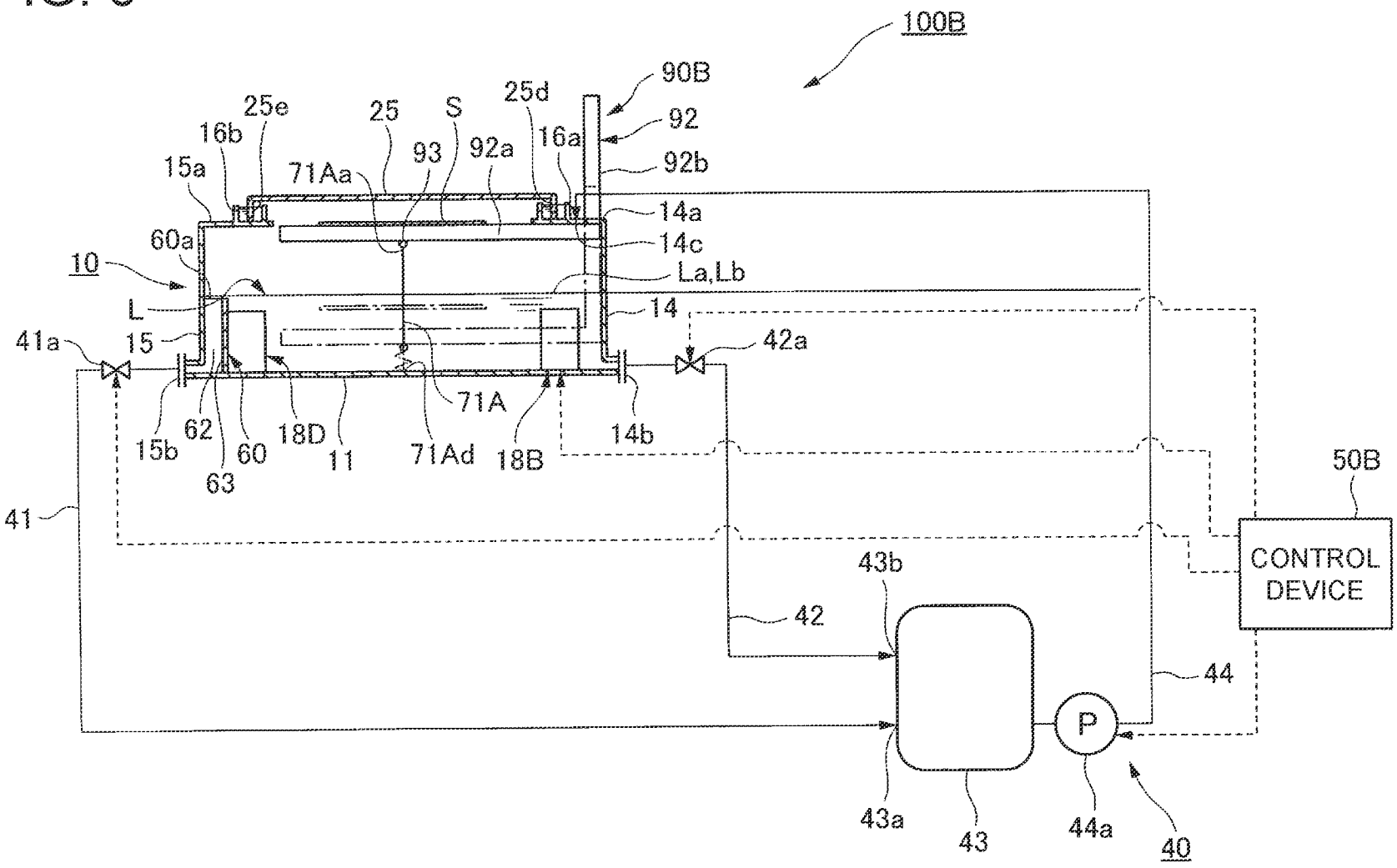
FIG. 6 is a cross-sectional view taken along line VI-VI in FIG. 5B.

With reference to FIGS. 5A, 5B, and 6, the pickling device according to the third embodiment of the present invention will now be described.

The present embodiment has a configuration in which the guide device, the cover member, the guide plate, and the control device provided for the above described first embodiment shown in FIGS. 1A, 1B, and 2 are modified, and a lift device is additionally provided. The other configuration is similar to that of the above described device shown in FIGS. 1A, 1B, and 2, and the same feature is indicated by the same reference numeral and not described again in detail.

As shown in FIGS. 5A, 5B, and 6, a pickling device 100B according to the present embodiment includes the same devices as the pickling device 100 according to the above described first embodiment, as well as two guide devices (steel strip guide device) 80A, 80B, two lifting devices (lifting units) 90A, 90B, and the control device 50B.

The guide devices 80A, 80B are devices for guiding the steel strip S in the pickling tank 10, from the inlet side to the outlet side (in the longitudinal direction) of the pickling tank 10 at a predetermined height. The guide devices 80A, 80B each include an immersion skid 81, and a support base 82 for supporting the immersion skid 81. The immersion skid 81 of the guide device 80A is disposed adjacent to the first and third heat exchangers 18A, 18C in the width direction of the pickling tank 10. The immersion skid 81 of the guide device 80B is disposed adjacent to the second and fourth heat exchangers 18B, 18D in the width direction of the pickling tank 10. The above immersion skids 81 allow the steel strip S to travel while being immersed in the acid solution L, below the liquid level La of the acid solution L, during pickling operation.

The lifting devices 90A, 90B are devices capable of lifting a supporting unit 92, between the position where the steel strip S is lifted above the liquid level La (Lb) of the acid solution L, and the position where the steel strip S is immersed in the acid solution L, inside the pickling tank 10. The lifting device 90A is disposed between the front plate 12 of the pickling tank 10 and the first and third heat exchanger bodies 18A and 18C. The lifting device 90B is disposed between the rear plate 13 of the pickling tank 10 and the second and fourth heat exchanger bodies 18B and 18D. The lifting devices 90A, 90B each include a supporting unit 92 having a L-shape. Each supporting unit 92 includes a root end portion 92*b* extending in the up-down direction, and a steel strip supporting portion 92*a* connected to the lower end of the root end portion 92*b* and extending in the width direction of the pickling tank 10 (width direction of the steel strip S) to support the steel strip S mounted thereon.

The above described pickling device 100B further includes a guide plate 71A disposed inside the pickling tank 10. The guide plate 71A is foldable in the height direction, and is configured to expand in the up-down direction when the lifting devices 90A, 90B lift the steel strip S above the liquid level of the acid solution L. The upper end portion 71Aa of the guide plate 71A is attached and fixed to the lower portion of the steel strip supporting portion 92*a* of the lifting devices 90A, 90B via the supporting portion 93. The supporting portion 93 has a shape which extends upstream in the traveling direction of the steel strip S from the lifting device 90A, and which extends downstream in the traveling direction of the steel strip S from the lifting device 90B. As the supporting portion 93, a portion having a strength that can support the upper end portion 71Aa of the guide plate 71A can be used. The lower end portion 71Ad of the guide plate 71A is fixed to the bottom plate 11 of the pickling tank 10.

Preferably, the guide plate 71A has a shape which extends upstream, with respect to the traveling direction of the steel strip S, from the front end portions 18Aa, 18Ca of the first and third heat exchangers 18A, 18C disposed most upstream with respect to the traveling direction of the steel strip S, and which extends downstream, with respect to the traveling direction of the steel strip S, from the rear end portions 18Bb, 18Dd of the second and fourth heat exchangers 18B, 18D disposed most downstream with respect to the traveling direction of the steel strip S. Accordingly, the front end portion 71Ab of the guide plate 71A is positioned on the upstream side of the first and third heat exchangers 18A, 18C, with respect to the traveling direction of the steel strip S. Furthermore, the rear end portion 71Ac of the guide plate 71A is positioned on the downstream side of the second and fourth heat exchangers 18B, 18D, with respect to the traveling direction of the steel strip S. Accordingly, in a range where the first to fourth heat exchangers 18A to 18D are arranged in the traveling direction of the steel strip S, the region on the side of the right plate 14 of the pickling tank 10 and the region on the side of the left plate 15 of the pickling tank 10 are divided in the width direction of the steel strip S. Furthermore, in the region upstream of the first and third heat exchangers 18A, 18C with respect to the traveling direction of the steel strip S and in the region downstream of the second and fourth heat exchangers 18B, 18D with respect to the traveling direction of the steel strip S, the acid solution L can flow between the regions on the side of the right plate 14 and the side of the left plate 15 of the pickling tank 10. Similarly to the pickling tank 10, it is sufficient if the guide plate 71A is made of an acid-resistant material. The pickling tank 10 may be made of a resin such as polypropylene, or a resin-based composite material.

Accordingly, when the supporting units 92 of the lifting devices 90A, 90B are lifted up, the supporting portion 93 is also lifted up along with the supporting units 92, and the upper end portion 71Aa of the guide plate 71A connected to the supporting portion 93 is also lifted up. Accordingly, the region is divided into the side of the heat exchangers 18A, 18C disposed adjacent to the right plate 14 of the pickling tank 10, and the side of the heat exchangers 18B, 18D disposed adjacent to the left plate 15 of the pickling tank 10. Thus, it is possible to make efficient use of all of the heat exchangers 18A to 18D in heating of the acid solution L from when the acid solution L is supplied to the pickling tank 10 and to when discharged from the pickling tank 10.

Furthermore, in the above described pickling device 100B, the upper side of the pickling tank 10 is covered with a plurality of (four in the illustrated example) cover members 25. Each cover member 25 includes a cover member body 25*a*, a front plate 25*b*, a rear plate 25*c*, a right plate 25*d*, and a left plate 25*e*. End portions of the front plate 25*b* and the rear plate 25*c* are immersed in the seal solution stored in the width-directional receiving portion 17. The right plate 25*d* and the left plate 25*e* are immersed in the seal solution stored in the right receiving portion 16*a* and the left receiving portion 16*b*, respectively.

The control device 50B is a device for controlling each device of the pickling device 100B. The output side of the control device 50B is connected to the heat exchangers 18A to 18D, the opening-and-closing valves 41*a*, 42*a*, the circulation pump 44*a*, and the lifting devices 90A, 90B, and is configured to be capable of controlling these devices. The control device 50B and the lifting devices 90A, 90B constitute the drawing unit.

The main operation of the above described pickling device 100B will be described below.

During pickling operation, similarly to the control device 50 of the above described pickling device 100, the control device 50B controls the heat exchangers 18A to 18D so as to heat the acid solution L to a predetermined temperature (e.g. 85 to 90° C.), controls the acid-solution circulation device 40 so as not to circulate the acid solution L, and controls the lifting devices 90A, 90B so that the steel strip S is not lifted above the liquid level La of the acid solution L. In other words, the control device 50B controls the opening-and-closing valves 41*a*, 42*a* disposed in the first and second drain pipes 41, 42 to be fully closed, and controls the circulation pump 44*a* to stop. Accordingly, inside the pickling tank 10, the acid solution L is heated to the predetermined temperature, and the liquid level La of the acid solution L is maintained at the substantially same level as the upper end portion 60*a* of the dam 60. Thus, the steel strip S undergoes the pickling process, by traveling through the acid solution L while being immersed in the acid solution L, guided by the immersion skid 81.

During pickling pause, in which pickling operation is stopped temporarily (e.g. from a couple of hours to one day), the control device 50B controls the lifting devices 90A, 90B so as to lift the steel strip S above the liquid level Lb of the acid solution L, while controlling the heat exchangers 18A to 18D so as to heat the acid solution L to a predetermined temperature (e.g. 85 to 90° C.), and controlling the acid-solution circulation device 40 so as to circulate the acid solution L. In other words, the control device SOB controls the supporting unit 92 so that the supporting units 92 of the lifting devices 90A, 90B move upward and lift the steel strip S above the liquid level Lb of the acid solution L, controls the opening-and-closing valve 42*a* disposed in the second drain pipe 42 to be fully closed, and controls the opening-and-closing valve 41*a* disposed in the first drain pipe 41 to be fully open. Accordingly, the steel strip S is lifted above the liquid level Lb of the acid solution L, and thereby the steel strip S is withdrawn from the acid solution L. The acid solution L inside the pickling tank 10 flows over the upper end portion 60*a* of the dam 60 toward the vicinity of the first drain port 15*b*, and then flows from the first drain port 15*b* through the first drain pipe 41 into the circulation tank 43, where the acid solution L is temporarily stored. Furthermore, the acid solution L inside the pickling tank L is discharged into the circulation tank 43 via the first drain pipe 41, such that the liquid level Lb of the acid solution L inside the pickling tank 10 becomes substantially flush with the upper end portion 60*a* of the dam 60. Then, the control device 50 controls the opening degree of the opening-and-closing valve 41*a*, and controls the circulation pump 44*a* to operate. Accordingly, the acid solution stored temporarily inside the circulation tank 43 flows into the pickling tank 10 via the supply pipe 44 in response to operation of the circulation pump 44*a*.

Furthermore, inside the pickling tank 10, as indicated by the arrow in FIG. 5A, once the acid solution L is supplied into the pickling tank 10 from the supply port 14*c*, the acid solution L flows along the right plate 14 (a side wall) of the pickling tank 10 toward each of the upstream side and the downstream side with respect to the traveling direction of the steel strip S. As the acid solution L reaches the most upstream side and the most downstream side, the acid solution L flows between the front end portion 71Ab of the guide plate 71A and the front plate 12 of the pickling tank 10, and between the rear end portion 71Ac of the guide plate 71A and the rear plate 13 of the pickling tank 10, respectively, toward the left plate (the other side wall) 15 of the pickling tank 10. Furthermore, the acid solution flows along the left plate 15 toward the first drain port 15*b* via the dam 60 in the center with respect to the traveling direction of the steel strip S.

Accordingly, during pickling pause, the steel strip S is lifted above the liquid level Lb of the acid solution L inside the pickling tank 10, and in this state, the acid solution L is circulated by the acid-solution circulation device 40A between the pickling tank 10 and the circulation tank 43, and the circulating acid solution L is guided by the guide plate 71A to the heat exchangers 18A to 18D through a predetermined flow path. Accordingly, the acid solution L is heated to the predetermined temperature by the heat exchangers 18A to 18D inside the pickling tank 10.

Thus, according to the present embodiment, similarly to the above described first embodiment, during pickling pause, in which pickling of the steel strip S is temporarily stopped, the acid solution L circulates between the pickling tank 10 and the circulation tank 43 while the steel strip is withdrawn from the acid solution L in the pickling tank 10, and thereby it is possible to prevent over-pickling of the steel strip S during pickling pause. Furthermore, the acid solution L is circulated between the pickling tank 10 and the circulation tank 43 by the acid-solution circulation device 40, and the guide plate 71A guides the acid solution L to the heat exchangers 18A to 18D, so that the heat exchangers 18A to 18D heat the acid solution L to a predetermined temperature. Thus, as compared to a case in which the total volume of acid solution is discharged from the pickling tank and stored in a tank separate from the pickling tank, a smaller volume of the acid solution L is returned to the pickling tank 10, which makes it possible to prevent a temperature decrease of the acid solution due to storage of the acid solution in a separate tank, and to shorten the time required to switch between pickling operation and pickling pause.

The control device 50B is configured to control opening and closing of the opening-and-closing valve 41*a*, operation of the circulation pump 44*a*, and the lifting devices 90A, 90B, so as to lift the steel strip S above the liquid level Lb of the acid solution L, thus being capable of withdrawing the steel strip S from the acid solution L. The guide plate 71A is foldable in the height direction, and is configured to expand in the up-down direction when the lifting devices 90A, 90B lift the steel strip S above the liquid level of the acid solution L. Therefore, even though the configuration is simple, the control device 50 can prevent over-pickling of the steel strip S during pickling pause reliably, shorten the time required to switch between pickling operation and pickling pause, and heat the acid solution L efficiently.

OTHER EMBODIMENTS

While the above described pickling device 100A includes the guide device 20 having a plurality of guide device bodies including the gutter-shaped member 22 with the immersion guide roll 23 and the skid 24, arranged in the traveling direction of the steel strip S, the present invention may be applied to a pickling device provided with a support roll supporting the lower side of the steel strip so as to allow the steel strip to travel.

While the above described pickling device 100, 100A includes the guide device 20 including four guide device bodies 21A to 21D, the number of guide device bodies is not limited to four, and may be three or less, or five or more, as long as the steel strip can be supported so as to be movable in the traveling direction of the steel strip while being immersed in the acid solution.

While the first drain port 15*b* and the second drain port 14*b* of the pickling tank 10 are connected to the first drain pipe 41 and the second drain pipe 42 and the supply port 14*c* of the pickling tank 10 is connected to the supply pipe 44 in the above described pickling tank 100, 100A, 100B, a flexible tube may be interposed between joints of the pickling tank and the drain pipe and the supply pipe. Accordingly, even if the pickling tank 10 thermally expands, the flexible tube can absorb thermal expansion of the pickling tank 10.

While the above described pickling device 100, 100A, 100B includes two heat exchangers 18 arranged next to one another in the traveling direction of the steel strip S in the vicinity of the right plate 14 and the left plate 15 of the pickling tank 10 (four heat exchangers 18A to 18D in total), the number of heat exchangers is not limited to two, and may be one, or three or more. The pickling device may include heat exchangers arranged only in the vicinity of the left plate 15 of the pickling tank 10, or only in the vicinity of the right plate 14 of the pickling tank 10.

While the above described pickling device 100, 100A includes the cover members 25 provided corresponding to the respective guide device bodies 21A to 21D, the pickling device may include a single cover member that covers the pickling tank 10 from above.

While the above described pickling device 100 includes the dam 60, the pickling device may include an overflow pipe disposed in the pickling tank as an inflow passage, which connects to the first drain port of the pickling tank at an end portion and has an inlet at the other end portion, positioned below the traveling height of the steel strip. Also in such a pickling device, the acid solution overflows through the overflow pipe such that the liquid level of the acid solution is adjusted to be below the traveling height of the steel strip, and thereby it is possible to withdraw the steel strip from the acid solution.

While the above described pickling device 100, 100A, 100B uses water seals to seal the end portions of the cover members 25, the pickling device may use rubber packing where rubber seals are attached to end portions of the cover members.

While the above described pickling device 100, 100A, 100B includes the heat exchangers 18A to 18D, the pickling device may include a device capable of heating the acid solution L to a predetermined temperature, such as a heater, in place of the heat exchangers.

While the above described pickling device includes a pickling tank and a circulation tank disposed below the pickling tank, the arrangement of a pickling tank and a circulation tank is not limited to this. It is sufficient if the acid solution can be circulated between the pickling tank and the circulation tank by the acid-solution circulation device. A circulation tank may be disposed above a pickling tank, or a pickling tank and a circulation tank may be disposed at the same level. Furthermore, while the above described acid-solution circulation device 40, 40A includes the opening-and-closing valve 41*a* disposed in the first drain pipe 41, and the circulation pump 44*a* disposed in the supply pipe 44, it is sufficient if the acid solution can be circulated between the pickling tank and the acid-solution circulation tank. The acid-solution circulation device may include pumps disposed in both of the drain pipe and the supply pipe, or may include pumps and opening-and-closing valves disposed in both of the drain pipe and the supply pipe, or may include a pump disposed in the drain pipe and an opening-and-closing valve disposed in the supply pipe.

INDUSTRIAL APPLICABILITY

According to the present invention, it is possible to prevent over-pickling of a steel strip during pickling pause and reduce the switching time between pickling operation and pickling pause. Thus, the present invention can be beneficially utilized in the metal manufacturing industry, for instance.

DESCRIPTION OF REFERENCE NUMERALS

10 Pickling tank
11 Bottom plate
14 Right plate
14*b* Second drain port
14*c* Supply port
15 Side plate
15*b* First drain port
16*a* Right receiving portion
16*b* Left receiving portion
17 Width-directional receiving portion
18A to 18D Heat exchanger
19*a*, 19*b* Fixed bracket
20 Guide device
21A to 21D Guide device body
22 Gutter-shaped member
23 Immersion guide roll
24 Skid
25 Cover member
26 Support block
31, 32 Skid
40, 40A Acid-solution circulation device (acid-solution circulation unit)
41 First drain pipe
41*a* Opening-and-closing valve
42 Second drain pipe
42*a* Opening-and-closing valve
43 Circulation tank (acid-solution storage tank)
43*a* First supply port
43*b* Second supply port
44 Supply pipe
44*a* Circulation pump
50, 50A, 50B Control device (withdrawing unit)
60 Dam

60*a* Upper end portion
64 Liquid level sensor (liquid-level measurement unit)
64*a* Tip end portion
71, 71A Guide plate
71*a*, 71Aa Upper end portion
71*b*, 71Ab Front end portion
71*c*, 71Ac Rear end portion
71*d*, 71Ad Lower end portion
80A, 80B Guide device
81 Immersion skid
82 Support base
90A, 90B Lifting device
92 Supporting unit
92*a* Steel strip supporting portion
92*b* Root end portion
93 Supporting portion
100, 100A, 100B Pickling device
h Traveling height of steel strip S
L Acid solution
La Liquid level (during pickling operation)
Lb Liquid level (during pickling pause)
S Steel strip

The invention claimed is:

1. A pickling device, comprising:
a pickling tank for storing acid solution and for pickling a steel strip by allowing the steel strip to travel therethrough while the steel strip is immersed in the acid solution;
a heating unit for heating the acid solution in the pickling tank;
an acid-solution storage tank for storing the acid solution, provided separately from the pickling tank;
an acid-solution circulation unit configured to circulate the acid solution between the pickling tank and the acid-solution storage tank;
a withdrawing unit configured to withdraw the steel strip from the acid solution; and
a guide plate disposed in the pickling tank and configured to guide the acid solution circulated in the pickling tank by the acid-solution circulation unit to the heating unit,
wherein the pickling tank includes:
a pair of side plates each of which extends along a traveling direction of the steel strip, the pair of side plates forming vertical walls of the pickling tank on opposite sides of the pickling tank,
a supply port for the acid solution disposed on one of the pair of side plates; and
a drain port for the acid solution disposed on the other one of the pair of side plates, and
wherein the guide plate extends along a plane including the traveling direction of the steel strip and an up-down direction, and is disposed between the drain port and the supply port.

2. The pickling device according to claim 1,
wherein a center portion of the pickling tank is positioned fixedly with respect to the traveling direction of the steel strip, and
wherein the drain port and the supply port of the acid solution are disposed on the center portion with respect to the traveling direction of the steep strip.

3. The pickling device according to claim 1,
wherein the guide plate has a shape which extends upstream in the traveling direction of the steel strip from the heating unit disposed upstream with respect to the traveling direction of the steel strip, and which extends downstream in the traveling direction of the steel strip from the heating unit disposed downstream with respect to the traveling direction of the steel strip.

4. The pickling device according to claim 1,
wherein the acid-solution circulation unit includes a flow passage between a drain port of the pickling tank and the acid-solution storage tank, a flow passage between a supply port of the pickling tank and the acid-solution storage tank, an opening-and-closing valve disposed in at least one of the two flow passages, and a pump disposed in at least the other one of the two flow passages, and
wherein the withdrawing unit is configured to withdraw the steel strip from the acid solution by controlling opening and closing of the opening-and-closing valve and operation of the pump to adjust a liquid level of the acid solution in the pickling tank to be below a traveling height of the steel strip.

5. The pickling device according to claim 4,
wherein the withdrawing unit includes an inflow passage which connects to the drain port of the acid solution disposed on the pickling tank and which has an inlet positioned below the traveling height of the steel strip, such that the acid solution overflows through the inflow passage and the liquid level of the acid solution is adjusted to be below the traveling height of the steel strip, and thereby the steel strip is withdrawn from the acid solution.

6. The pickling device according to claim 1,
wherein the withdrawing unit includes a lifting unit capable of withdrawing the steel strip from the acid solution by lifting the steel strip above a liquid level of the acid solution, and
wherein the guide plate is foldable in a height direction, and is configured to open in a vertical direction when the steel strip is lifted above the liquid level of the acid solution by the lifting unit.

7. The pickling device according to claim 6,
wherein the lifting unit includes a supporting portion extending in a width direction of the pickling tank, for mounting the steel strip,
wherein the supporting portion is movable between a position where the steel strip is immersed in the acid solution and a position where the steel strip is lifted above the liquid level of the acid solution, and
wherein the guide plate has an upper portion attached to a lower portion of the supporting portion, and a lower portion fixed to a bottom plate of the pickling tank.

8. The pickling device according to claim 1,
wherein the heating unit is a heat exchanger.

9. A pickling device comprising:
a pickling tank for storing acid solution and for pickling a steel strip by allowing the steel strip to travel therethrough while the steel strip is immersed in the acid solution;
a heating unit for heating the acid solution in the pickling tank;
an acid-solution storage tank for storing the acid solution, provided separately from the pickling tank;
an acid-solution circulation unit configured to circulate the acid solution between the pickling tank and the acid-solution storage tank;
a withdrawing unit configured to withdraw the steel strip from the acid solution; and
a guide plate disposed in the pickling tank and configured to guide the acid solution circulated in the pickling tank by the acid-solution circulation unit to the heating unit, wherein the pickling tank includes a pair of side plates each of which forms a vertical wall of the pickling tank on opposite sides of the pickling tank, wherein the heating unit is arranged along each of the pair of side plates of the pickling tank inside the pickling tank, and wherein the guide plate is disposed between the heating unit disposed along one of the pair of side plates and the heating unit disposed along the other one of the pair of side plates.

10. A The pickling device comprising:

a pickling tank for storing acid solution and for pickling a steel strip by allowing the steel strip to travel therethrough while the steel strip is immersed in the acid solution;

a heating unit for heating the acid solution in the pickling tank;

an acid-solution storage tank for storing the acid solution, provided separately from the pickling tank;

an acid-solution circulation unit configured to circulate the acid solution between the pickling tank and the acid-solution storage tank;

a withdrawing unit configured to withdraw the steel strip from the acid solution; and a guide plate disposed in the pickling tank and configured to guide the acid solution circulated in the pickling tank by the acid-solution circulation unit to the heating unit, wherein the acid-solution circulation unit includes a flow passage between a drain port of the pickling tank and the acid-solution storage tank, a flow passage between a supply port of the pickling tank and the acid-solution storage tank, an opening-and-closing valve disposed in at least one of the two flow passages, and a pump disposed in at least the other one of the two flow passages, wherein the withdrawing unit is configured to withdraw the steel strip from the acid solution by controlling opening and closing of the opening-and-closing valve and operation of the pump to adjust a liquid level of the acid solution in the pickling tank to be below a traveling height of the steel strip, wherein the withdrawing unit includes an inflow passage which connects to the drain port of the acid solution disposed on the pickling tank and which has an inlet positioned below the traveling height of the steel strip, such that the acid solution overflows through the inflow passage and the liquid level of the acid solution is adjusted to be below the traveling height of the steel strip, and thereby the steel strip is withdrawn from the acid solution, and wherein the inflow passage is a dam which surrounds the drain port of the acid solution.

* * * * *